US005481830A

United States Patent [19]

Gooding et al.

[11] Patent Number: 5,481,830

[45] Date of Patent: Jan. 9, 1996

[54] DOOR CHECK FOR VEHICLE SLIDING DOOR

[75] Inventors: Roger C. Gooding; Lloyd W. Rogers, Jr., both of Shelby Township, Mich.

[73] Assignee: General Motors Corporation, Detroit, Mich.

[21] Appl. No.: 205,422

[22] Filed: Mar. 4, 1994

[51] Int. Cl.[6] ..... E05B 55/00

[52] U.S. Cl. ..... 49/449; 49/213; 292/67; 292/DIG. 46

[58] Field of Search ..... 49/449, 209, 213, 49/360; 292/DIG. 46, 67, 175, 193

[56] References Cited

U.S. PATENT DOCUMENTS 4,502,246 3/1985 Minami ..... 49/449 X
5,361,540 11/1994 Rogers, Jr. et al. ..... 49/449

FOREIGN PATENT DOCUMENTS 2135724 9/1984 United Kingdom ..... 49/449

*Primary Examiner*—Philip C. Kannan
*Attorney, Agent, or Firm*—Ernest E. Helms

[57] ABSTRACT

A door check arrangement for a van door is provided which, in a preferred embodiment, includes an arm connected to the door and translationally connected to the vehicle along an end; a track mounted within the vehicle receiving the arm and having a striker plate and an entrapment section; a support connected to the arm second end and having a first slot with first and second ends and a second slot with first and second surfaces angled from one another; a detent plate having a surface inclined with respect to the striker plate and also having first and second pivot pins mounted within the first and second slots; and a spring biasing the detent plate to place the first pivot pin toward the first slot first end and the second pivot pin on the first surface of the second slot, whereby motion of the door from a closed to a checked open position causes the detent plate inclined surface to contact the striker and to pivot the detent plate in a first angular direction and wherein further movement of the door toward a checked open position causes the detent plate to pivot again in a second angular direction opposite the first angular direction to place the detent plate in the entrapment section of the track with a low first threshold of force on the door in the opening direction and wherein the door is thereafter checked open even when the vehicle is on a declining surface toward the first end of the first slot.

5 Claims, 2 Drawing Sheets

DOOR CHECK FOR VEHICLE SLIDING DOOR

FIELD OF THE INVENTION

The field of the present invention is that of door check arrangements for sliding doors in van-type vehicles.

BACKGROUND OF THE INVENTION

Most van- or minivan-type automotive vehicles have a sliding side door on the passenger side of the vehicle. Typically, this door has upper, belt level and lower arms which connect the sliding side door with the vehicle. The lower arm has one end fixed with the door and a second end with a roller which rides within a track provided on the side of the vehicle. To keep the door in an open position when the door has been fully opened, typically the track in which the lower arm roller rides will have a slight mound or hump so that once the door is opened, it will remain in the opened position. The above-noted detent system works well, with the exception when the van is parked nose-down on declining terrain wherein the gravitational force exerted on the door will often cause it to close, even after it has been pulled back to a fully open position.

It would be advantageous if a door checking system was arranged wherein the door would automatically be detented in the open position, would maintain that detented position even when the vehicle is parked on a steep slope and would allow the use of manual or automatic door opening systems and would also allow the door (in both manual and automatic systems) to close by simply manually pulling the door closed.

SUMMARY OF THE INVENTION

The present invention provides a door detent arrangement which meets the needs of providing a door detenting arrangement which automatically detents the door on a slight opening effort of the door, allows the door to stay in the detented position when the vehicle is on an incline, and then additionally allows the door to be closed by a simple low effort pull upon the door without requiring any additional latch mechanisms to release the door from the detented position. Therefore, the present invention can be freely used on both manually opening and automatically opening van-type vehicle doors. The present invention is also an alternative to the door detent arrangement provided in Rogers, U.S. Ser. No. 08/128,517, filed Sep. 29, 1993, now U.S. Pat. No. 5,361,540.

DESCRIPTION OF THE PREFERRED EMBODIMENTS

Figure 1:
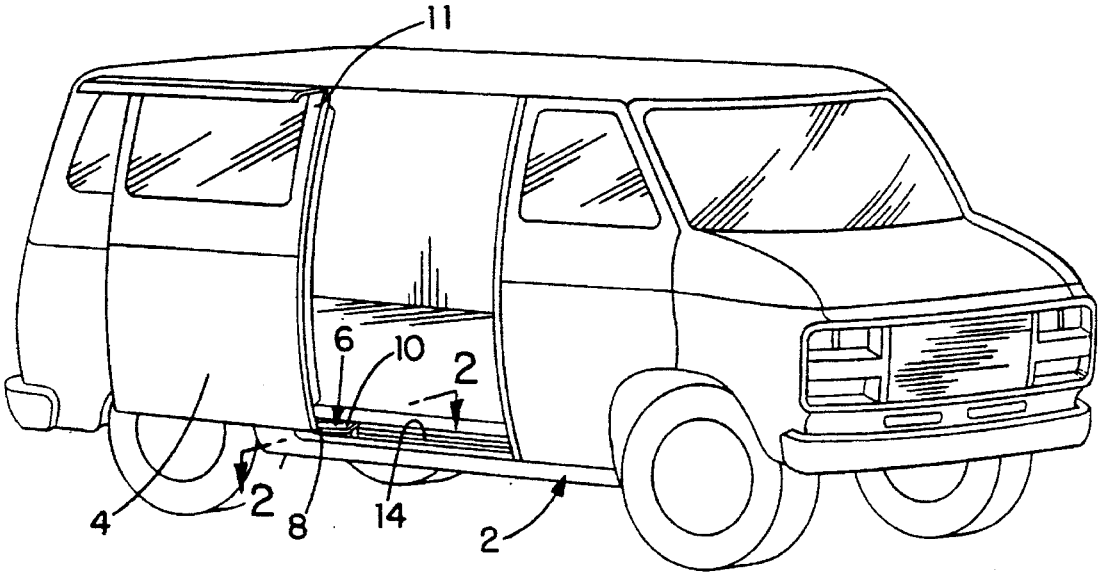
FIG. 1 is a perspective view of a van-type vehicle utilizing the present invention.

Referring to FIGS. 1 through 4, the present invention is shown in the environment of a vehicle van 2. The van 2 has a sliding vehicle door 4. The van door is slidably captured at its top end 11 with the van 2 and has joined to its bottom end an arm. 6. The arm 6 has a first end 8 fixably connected with the vehicle door. The arm 6 has a second end 10 which has a vertically mounted roller 12 and a horizontally mounted roller 16 allowing the arm 6 to be translationally connected with the vehicle 2.

The rollers 12, 16 run in a track 14. The horizontally mounted roller 16 engages a portion of the track (not shown). A detent arrangement 7 at the rearward end of track 14 has a bumper 18 which is incorporated into a striker bracket 19. The major dimensions of the track 14 are generally parallel to the major axis of the van 2 with a slight movement inward toward the van centerline at the very front end of the track (not shown). The striker bracket 19 also has a striker plate 20 with a front end 22. Toward an end of the striker 20, there is an entrapment section 24 (best shown in FIG. 3) for acceptance of a detent plate 58 when the detent arrangement 7 is in the detented or checked position.

The roller 12 is mounted to the arm 6 by a pin 28 which crosses a generally U-shaped bracket 30. Connected with the arm 6 generally adjacent its second end 10 is a U-shaped support 32. The support 32 is connected to the arm 6 by a fastener, welding or other suitable connective means. The support has a central body portion 34 which is integrally joined to two generally identical ears 36. The support at its rearward end has a tail 38. Tail 38 has a mounting pin or stamped embossment 40 (FIG. 2).

Each ear 36 has a longitudinal first slot 42 with a first end 44 and a second end 46. Intersecting the first slot 42 is a detent plate installment slot 48. Each ear 36 also has a second slot 50. The second slot 50 has a first surface 52, a second surface 54 and a third surface 56. The second slot first surface 52 is parallel and angularly aligned with the first slot 42. The first, second and third surfaces 52, 54 and 56 are angled from one another. In another embodiment (not shown), the second surface is curvilinear in the form of a radius.

The last major element of the detent arrangement 7 is the detent plate 58. The detent plate 58 has a surface 60 which is inclined with respect to the striker plate 20. The inclined surface 60 is provided by a stamped depression in a main body 66 of the detent plate. The detent plate 58 has opposing first and second 68, 70 pivot pins mounted within the first and second slots 42, 50. The detent plate also has a tail 72 with a pin extension 74 which mounts a coil spring 80 (approximately 10 lbf/in with a maximum force range of 18 to 20 lbf) which is also captured around the support tail pin 40. Pins 40, 74 extend in an orientation parallel to the first slot 42.

Figure 2:
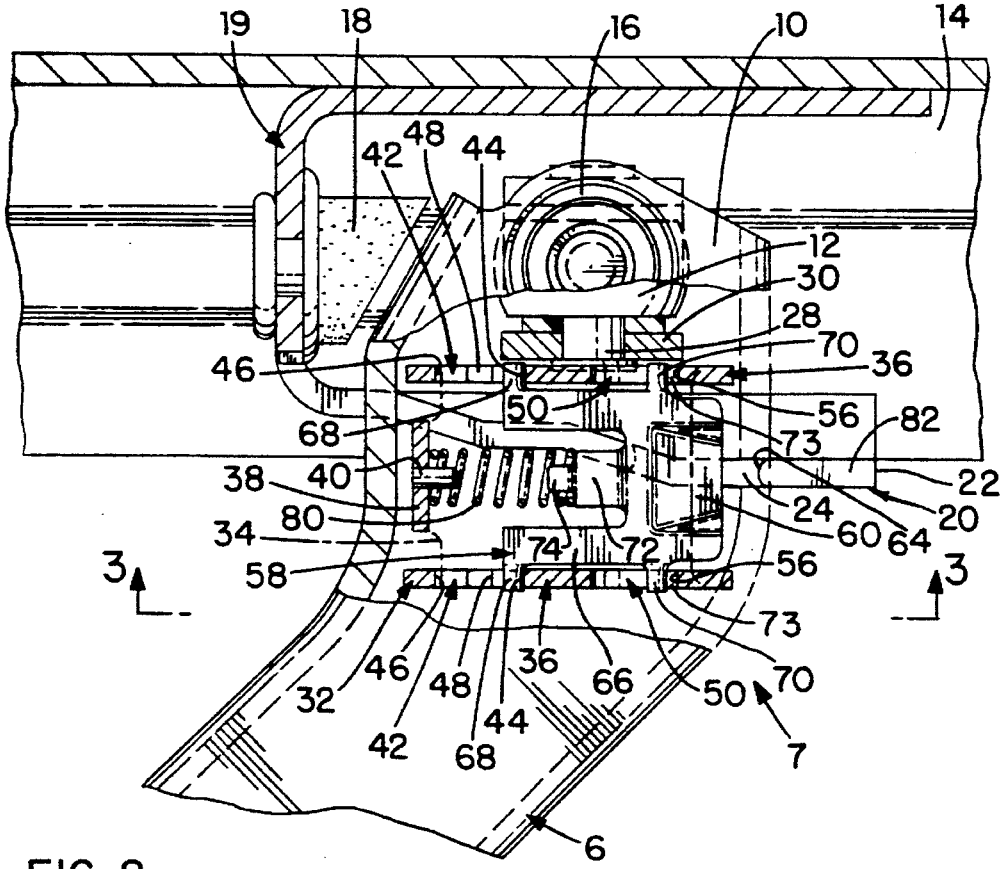
FIG. 2 is a view taken along line 2—2 of FIG. 1.
Figure 3:
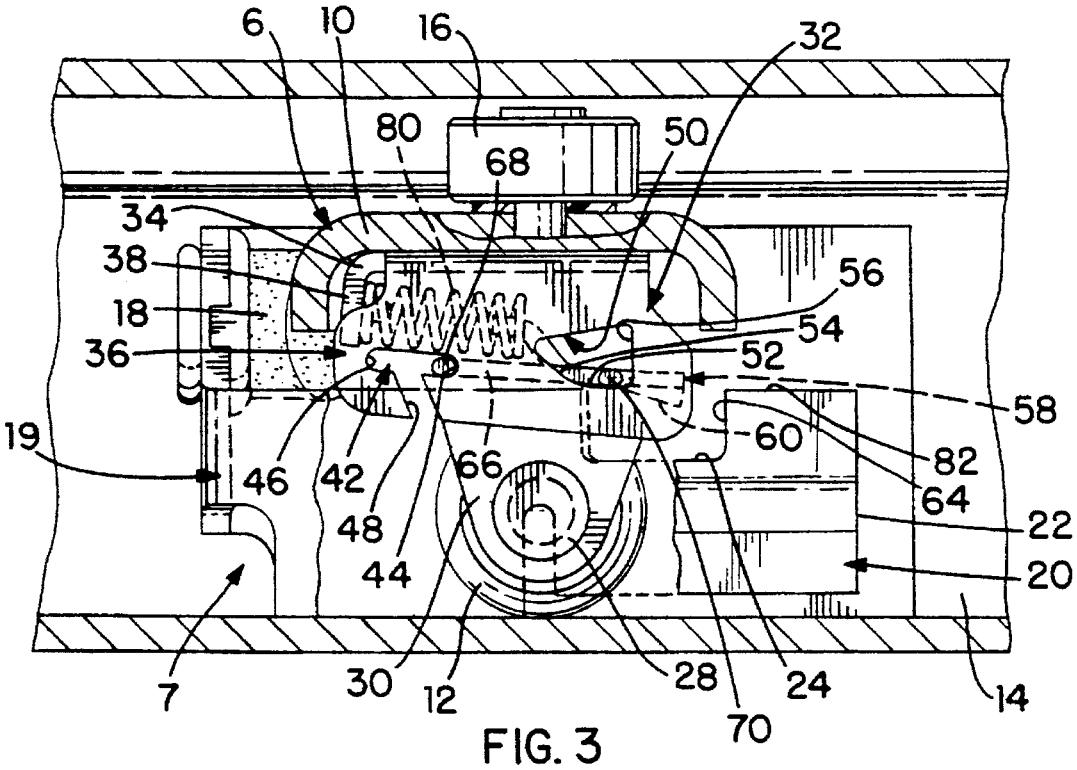
FIG. 3 is a view taken along line 3—3 of FIG. 2.
Figure 4:
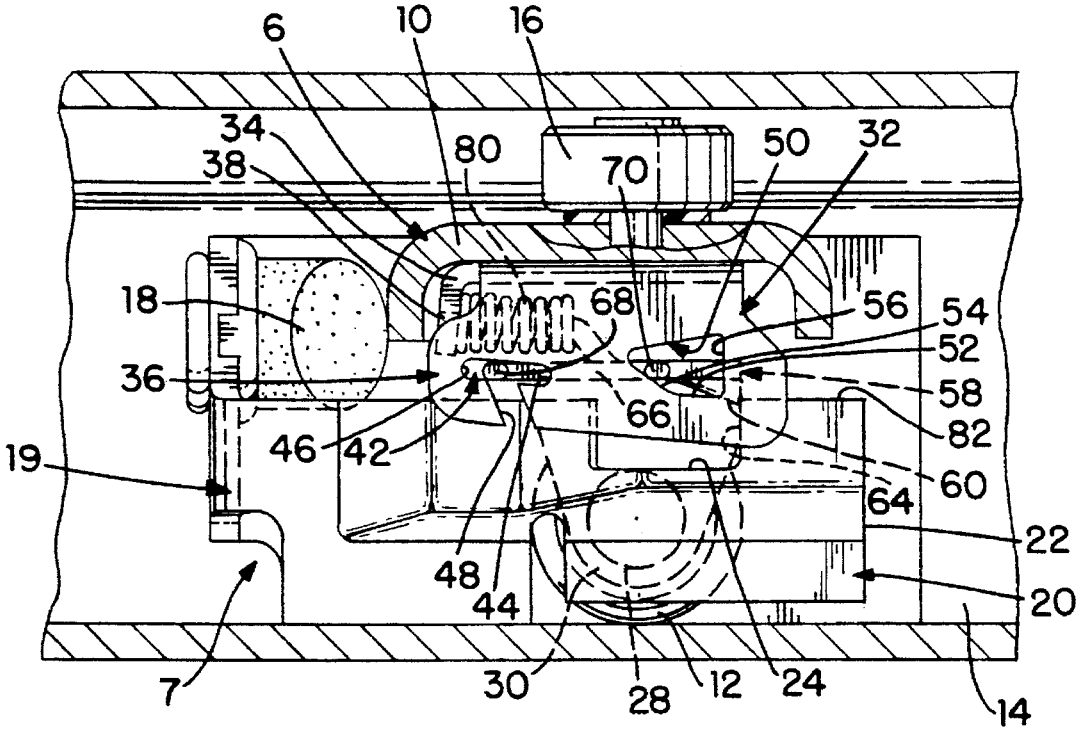
FIG. 4 is a view similar to FIG. 2, showing operation of the present invention when releasing the checking arrangement and closing the door.

The spring, as best shown in FIGS. 2 and 3, biases the detent plate 58 to place the second pivot pin 70 on the second slot first surface 52 and the first pivot pin 68 at the first end 44 of the first slot. The spring 80 also acts to urge the detent plate 58 to rotate in a first angular, clockwise direction (as shown in FIGS. 3 and 4) which utilizes the rear pivot pin 68 as a pivot point in the normal rest position of the detent plate. As shown in FIG. 2, there is a slight clearance 73 between the second pivot pin 70 and the third wall 56 of the second slot 50. Clearance 73 ensures against any binding between pivot pin 70 and the third wall 56.

Operation of the door check arrangement is as follows. When the door 4 is taken from a closed position to a checked (detented) open position, the detent plate 58 will essentially be in the position shown in FIGS. 2 and 3. Upon hitting the leading edge 22 of the striker plate 20, the inclined surface 60 will be pushed upwardly, causing the second pivot pin 70 to move upward adjacent the third surface 56 and the detent plate 58 to pivot in a first, counterclockwise direction as it rides on a top surface 82 of the striker plate. As the door 4 continues to move toward a checked position leftwardly, the inclined surface 60 will fall off the leading edge 64 of the striker plate, allowing the detent plate 58 to pivot clockwise to a checked position as best shown in FIG. 3. The force needed on the door to come from an open checked position will be rather slight, in the neighborhood of three to five pounds force.

To move the door from the checked position shown in FIG. 3 to a release position, the door 4 is moved rightwardly, bringing the inclined surface 60 into contact with the leading edge 64 of the striker bar. If the vehicle is on an incline, the gravitational force on the door will not overcome this locking relationship between the detent plate 58 and the striker plate 20. To close the door, a pull of approximately 25 pounds force will be needed. Typically, in vans utilized in noncommercial enterprises, the pulling force to close the van door will be made lower. However, in commercial vehicles, a spring 80 with a higher spring force may be substituted to tailor the closing force to the design requirements of the vehicle. When a sufficient closing force is placed on the door, the detent plate second pivot pin 70 will move leftwardly on the first surface 52 and will start riding up the second surface 54. The first pivot pin 68 will move toward the second end 46 of the first slot. The above motion of the detent plate 58 against the force of the spring 80 will cause the detent plate to pivot in the second angular direction, releasing the detent plate 58 from the striker plate 20 to such a point that the inclined surface 60 will then ride upon the top 82 of the striker plate 20 and further forward motion will allow the door 4 to move forward freely.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A door check arrangement for a sliding door of a vehicle comprising:

an arm generally fixably connected to the door along a first end of the arm, and the arm being generally translationally connected to the vehicle along a second end of the arm;

a track mounted within the vehicle for receiving the second end of the arm, the track having a striker plate and an entrapment section;

a support connected to the arm generally adjacent the second end of the arm, the support having a first slot with first and second ends and a second slot having first and second surfaces angled from one another;

a detent plate having a surface inclined with respect to the striker plate, the detent plate also having first and second pivot pins mounted within the first and second slots;

spring means biasing the detent plate to place the first pivot pin toward the first slot first end and the second pivot pin on the first surface of the second slot, whereby motion of the door from a closed position to a checked open position causes the detent plate inclined surface to contact the striker and to pivot the detent plate in a first angular direction and wherein further movement of the door toward a checked open position causes the detent plate to pivot again in a second angular direction opposite the first angular direction to place the detent plate in the entrapment section of the track with a low first threshold of force on the door in the opening direction and wherein the door is thereafter checked open even when the vehicle is on a declining surface toward the first end of the first slot, and wherein pulling the door closed from the open checked position with a second force on the door significantly higher than the first opening force causes the detent plate to contact the striker and the first pivot pin to move toward the first slot second end and for the second pivot pin to move from the second slot first surface to the second slot second surface, thereby causing the detent plate to pivot in the first angular direction and causing the detent plate to pivot out of the entrapment section to allow the detent plate to release the door from the checked position.

2. A door check arrangement as described in claim 1 wherein the first slot and the first surface of the second slot are parallel to one another.

3. A door check arrangement as described in claim 2 wherein the first slot and the first surface of the second slot are aligned with one another.

4. A door check arrangement as described in claim 1 wherein the second slot has a third surface and when the door is moved from a closed position to a checked position, the second pivot pin moves adjacent the second slot third surface.

5. A door check arrangement for a sliding door of a vehicle comprising:

an arm generally fixably connected to the door along a first end of the arm, and the arm being generally translationally connected to the vehicle along a second end of the arm;

a track mounted within the vehicle for receiving the second end of the arm, the track having a striker plate and an entrapment section;

a support connected to the arm generally adjacent the second end of the arm, the support having two opposed ears, each ear having a first slot with first and second ends and a second slot having first, second and third surfaces angled from one another, the first slot and the second slot first surface being parallel and aligned with one another;

a detent plate having a surface inclined with respect to the striker plate, the detent plate having opposing first and second pivot pins mounted within the respective first and second slots; and a spring biasing the detent plate to place the first pivot pin toward the first end of the first slot and the second pivot pin on the first surface of the second slot, whereby motion of the door from a closed position to a checked open position causes the detent plate inclined surface to contact the striker and to move the second pivot pin adjacent the second slot third surface and to pivot the detent plate in a first angular direction and wherein further movement of the door toward a checked open position causes the detent plate to pivot again in a second angular direction opposite the first angular direction to place the detent plate in the entrapment section of the track with a low first threshold of force on the door in the opening direction, and wherein the door is checked even when the vehicle is on a declining surface toward the first end of the first slot, and wherein pulling the door closed from the open checked position with a second force on the door significantly higher than the first opening force causes the detent plate to contact the striker and for the detent plate second pivot pin to move from the second slot first surface to the second slot second surface and for the first pivot pin to move toward the second slot second end, thereby causing the detent plate to rotate in the first angular direction and causing the detent plate to pivot out of the entrapment section to allow the detent plate to release the door from the checked position.

* * * * *